US005471692A

United States Patent [19]

Wasinger et al.

[11] Patent Number: 5,471,692

[45] Date of Patent: Dec. 5, 1995

[54] MECHANICAL DESIZING AND ABRADING APPARATUS

[76] Inventors: Eric M. Wasinger, 16403 Ledge Way, San Antonio, Tex. 78232; Gary Gates, 8025 Jethro, San Antonio, Tex. 78266

[21] Appl. No.: 235,081

[22] Filed: Apr. 29, 1994

[51] Int. Cl.[6] ..... D06F 37/06

[52] U.S. Cl. ..... 8/159; 68/142; 68/183; 241/300; 451/32; 451/328

[58] Field of Search ..... 8/159; 68/13 R, 68/24, 28, 60, 142, 144, 183; 451/32, 328; 241/278.2, 300; 69/30

[56] References Cited

U.S. PATENT DOCUMENTS 1,344,551 6/1920 Masheck ..... 68/60 X 1,508,345 9/1924 Lupo ..... 451/328

2,305,695 12/1942 Hayes ..... 68/60

3,146,196 8/1964 Bochan et al. ..... 68/142 X 4,881,385 11/1989 Lambrechts ..... 68/144 X

*Primary Examiner*—Philip R. Coe

*Attorney, Agent, or Firm*—John Lezdey

[57] ABSTRACT

A rotary drum washer-extractor having an abrasive structure therein for treating fabrics or garments in a wash medium and a method of abrading fabrics or garments employing the abrasive structure to produce a controlled abrasion of the fabrics or garments are disclosed. The abrasive structure is formed preferably of a corrosion resistant material wherein the material forms an abrasive surface affixed to metal surface by a molten metal technique.

21 Claims, 1 Drawing Sheet

MECHANICAL DESIZING AND ABRADING APPARATUS

FIELD OF THE INVENTION

This invention relates to rotary drum washer-extractor having abrasive structures therein for abrading and desizing fabrics or garments. More particularly, this invention relates to abrasive structures to be used in a "stone washing" process and to methods for treating fabrics and garments to achieve a controlled abrasion of those fabrics and garments.

DESCRIPTION OF THE PRIOR ART

Stone washing is the term used to describe methods for imparting a soft look to new garments particularly those made of denim. Generally, prior art methods employed for stone washing involve the use of pumice stones. These large stones (2 inches or larger) circulate with the garments in suitable equipment such as a commercial rotary-drum washer-extractor, abrading and softening the garments. However, there are major disadvantages with this method including damage to the equipment along with causing tears and holes in the garments. The rotation or agitation of the drum also causes the large stones to strike the inside of the drum resulting in damage thereto. These collisions break the pumice stones and form sharp edges on the resulting smaller particles which exacerbates the damage to the garments and equipment. Another disadvantage of the pumice stone method is that after each abrading treatment, the stones and stone fragments must be laboriously removed from the drum as the fabrics and garments are prepared for rinsing and drying. This is particularly of concern in commercial operations since this removal is time consuming and a labor intensive operation.

Another prior art method involves the use of a washer drum which has been roughen by abrasive agents such as pumice or other volcanic rock. Fabrics and garments are placed in the drum and are abraded by the rough surface of the drum. The disadvantages of this method include the time and cost of repeated resurfacings of the drum and the considerable processing time required to obtain the desired results on the garments.

In summary the major disadvantages of the above described methods include the unintentional abrasion of the inside wall of the washer cylinder or drum, the costs and time involved in filtering out the pumice from the wash liquid, the necessity to have one or more subsequent rinse steps to remove pumice from the garments after the abrasion step. Additionally there is constant attrition and loss of abrasive material, which requires that substantial quantities of abrasive material be replaced. Furthermore, obtaining uniform abrasion has not proved successful with existing methods.

SUMMARY OF THE INVENTION

It is now been found that a suitable abrasive structure in which the aforementioned disadvantages or drawbacks are eliminated or substantially reduced and in which the range of usefulness of the abrasive structure is greatly extended. According to the present invention there is provided in a washer-extractor having a rotatable barrel, an abrasive structure mounted for rotation with the barrel comprising:

(1) a structural form having substantial structural exterior metal surface area; and (2) a layer of a corrosion resistive abrasive material affixed to said exterior metal surface area;

wherein said abrasive material is affixed to said exterior metal surface area by using molten metal techniques forming peaks and valleys.

An arc spray system is the preferred molten metal technique.

The abrasive structure is useful particularly as a tumbling rib and/or panels in commercial washers-extractors either as initial construction or as a modification to existing machines to produce a stone washing effect on fabrics and garments. Preferably the abrasive structure is provided with a plurality of openings that range from 0.2 to about 1 cm and more preferably about 0.3 to about 0.5 cm. The openings should be such that buttons or snaps which are found on the garments do not get caught and cause damage to that garment. The shape of the openings is not critical. Openings which are round or elliptical are easily produced by a simple punching operation.

The invention further provides a method which comprises introducing into a rotary drum washer-extractor equipped with at least one abrasive structure, water and optionally fabric treatment compositions to uniformly abrade and clean the fabrics and garments. These fabrics and garments are then rinsed with an appropriate fluid which is subsequently drained from the drum and then the workpieces are removed from the washer-extractor. The method exposes the fabrics or garments to a considerably greater and more uniform surface area of abrasive structure providing even and more rapid abrasion with little or no damage to the fabrics.

In another preferred embodiment, a decolorizing agent such as ozone is added to the aqueous medium during the abrading process to decolorize the fabrics or garments.

It is a primary object of this invention to provide an abrasive structure having a uniform abrasive surface which will not damage or excessively wear fabrics and garments being subject to a stone washing method which will not deteriorate during use, and which will provide uniformly stone washed garments having a consistent nap and low level amount of textile wear.

It is also an object of this invention to provide a method for use in the abrading of fabrics and garments which is more efficient, has a more uniform surface area and yields a fabric or garment with little or no damage to the workpiece.

It is another object of this invention to provide a novel mechanical means for desizing and abrading fabric and garments in a single operation.

It is a further object of this invention to provide a means for desizing and abrading denims for additional treatment with a decolorizing agent.

It is still a further object of this invention to provide processes for stone washing garments, particularly denim garments, as well as, fabrics in general, which are less wearing on the commercial washing equipment which employ reduced amounts of abrasive material such that energy requirements are less and which provide satisfactory and uniform wear characteristics on the garments which are treated.

DETAILED DESCRIPTION OF THE PREFERRED EMBODIMENTS

Figure 1:
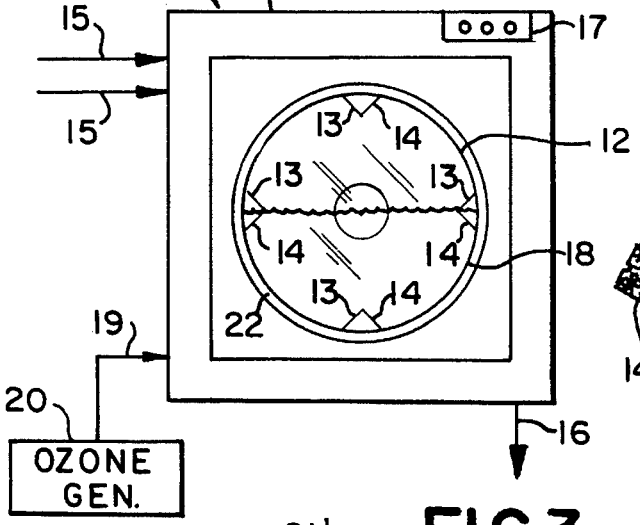
FIG. 1 is a front elevational view of a washer-extractor with one form of abrasive panels of the invention.

In accordance with the present invention the above mentioned and other objects are achieved by employing structures for abrading fabrics as in stone washing processes which comprise a substantial structural exterior metal surface area and a layer of material forming an abrasive surface affixed thereto by molten metal techniques. Any suitable high temperature process which liquifies the metal for forming the abrasive surface, allows transfer of the liquified metal and permits some penetration into the surface area to effect a welding bond of the liquified metal to the metal surface area or substrate, may be used. For example, welding, oxy/fuel guns or arc or plasma spray systems may be employed by the present invention.

The most preferred method of application of the abrasive metal material is an arc spray system. The abrasive material is loaded into an arc spray gun as a continuous wire feed, the gun heats the wire with an electric arc to a temperature which liquifies the wire then under air pressure sprays it onto the target metal surface areas to produce a strong weld bond. Example of such arc spray gun is a Hobart/Tafa Model 9000 Electric Drive Arc Spray System, Hobart Tafa Technologies, Inc., Concord, N.H. The Model 9000 gun may be either a hand held or machine mounted unit. This allows for maximum versatility. The arc spray gun can reproduce optimum spray patterns for each composition of wire and thus produce the highest quality coating with the highest density and bond strength. The use of small diameter wire such as about 1 mm to 2 mm provides a more uniform particle distribution in the spray pattern. The spray pattern shape can be varied by adjusting the nozzle/positioner insert and can be made fine or coarse by adjusting the air pressure and nozzle cap diameter. Low pressures give coarse coatings. For example, low pressures produce very rough coatings with an average 3.2 mm peak-to-valley roughness. While pressures of about 80 psi gives extremely fine particle size. The compressed air for spraying should be free from foreign matter, oil and water. Preferably, the pressures should range from about 1 to 10 psi to produce a peak-to-valley roughness of about 2.0 to about 5.0 mm.

The arc spray because of its high operating temperatures requires special wire metallurgy and particularly for use in a stone washing type process should be corrosion resistant, provide a durable abrasive surface. Preferably the wire should have a hardness of about 40 to about 100 Rockwell. Suitable abrasive material alloys include nickel-chrome, nickel-chrome-moly, stainless steel 18/5, stainless steel 18/8, titanium and zinc. Particularly preferred are stainless steel alloys designated 304L to 326. Accordingly for the purposes of this invention it is most preferable that a corrosive resistant metal is employed as the structural exterior metal surface and that it is to be compatible with the abrasive material to avoid electrolysis. Therefore, it is most preferred to apply stainless steel to stainless steel.

Prior to the arc spray application of the abrasive material the structural exterior metal surface area or target substrate must be degreased, sand or bead blasted and cleaned. Failure to provide the necessary surface preparation will result in poor bonding of the abrasive material.

In a preferred embodiment the abrasive structure particularly when used in a rotary drum washer-extractor is a rectilinear panel having a plurality of openings or holes are provided. The holes may be punched or drilled before or after the abrasive material is applied. The openings or holes should be designed to permit water drainage, as well as, prevent buttons or snaps which are found on the garments from falling through or getting caught and causing damage to that garment. The openings range from about 0.2 cm to about 1 cm and preferably about 0.3 cm to about 0.5 cm. The shape of the openings is not critical. Preferably the openings are round or elliptical in shape for ease in manufacture.

The abrasive panels are suitably made from corrosion resistant sheet metal, e.g., 12 to 10 gage material stainless steel. The thickness is not critical and only limited by weight considerations regarding the operation of the rotary drum washer-extractor.

Referring to FIG. 1 a rotary drum washer-extractor 10 having a housing 11, water inlet lines 15, 15' drain line 16, control board 17 and an access door 12 is provided with the abrasive structure 13 of this invention as tumbling ribs 14 along the drum interior 18. In the preferred embodiment of the present invention a commercial washer-extractor such as Washex Tumbler manufactured by Washex Corp., Wichita Falls, Tex. However, any vessel capable of retaining and agitating the fabrics or garments can be employed including conventional household washing machines. The abrasive structures 13 are substantially rectilinear and can be used as a single panel along the interior but preferably are also adapted to form triangular-shaped ribs 14. The length of the ribs 14 are not essential but preferably run the length of the drum. As mentioned hereinbefore the weight of the abrasive panels are not critical so long as they do not interfere with the operation of the washer-extractor. Also the height or protrusion of the ribs 14 into the drum is not critical but should be about 3 cm to about 8 cm. The ribs 14 can be installed during the initial construction of the washer-extractor or the tumbling ribs of conventional washer-extractor can be modified by attaching panels of the abrasive structure to the existing tumbling ribs with suitable removable fasteners or by welding. Similarly, the interior of the washer-extractor can have the abrasive panels installed.

In another embodiment, the washer-extractor 10 can be connected through line 19 to an ozone generator 20. The ozone bleaches and enhances the desizing and stone wash process. However, other bleaching steps can also be used.

Figure 2:
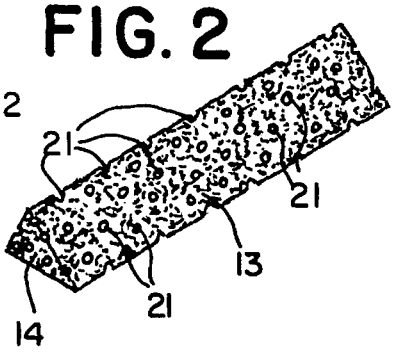
FIG. 2 is a perspective view of the panels with circular openings of FIG. 1.
Figure 3:
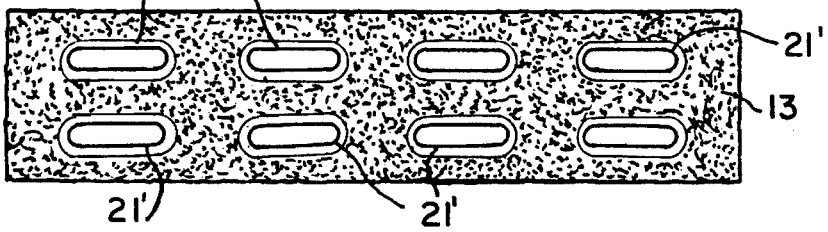
FIG. 3 is a plan view of another form of a panel with elliptical openings.
Figure 4:
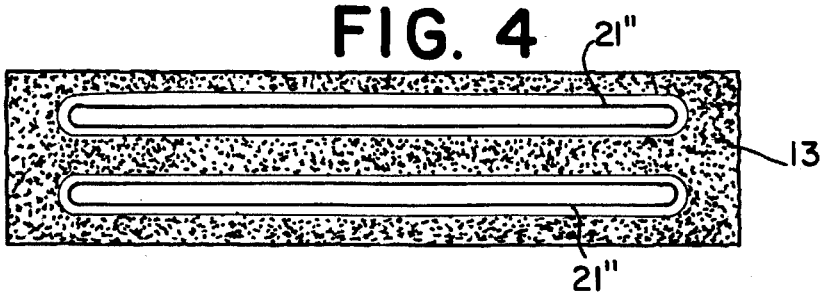
FIG. 4 is a frontal elevation view of a removable abrasive structure for insertion into a conventional household washing machine.

FIG. 2 illustrates a multiplicity of abrasion structure panels 13 with holes or openings 21 arranged in rows to form a tumbling rib 14 that can be attached to the interior of the rotary drum 18. The holes or openings 21 serve several functions; they reduce the weight of the tumbling rib 14 and permit process liquids to drain through to the outside shell 22 (FIG. 1). FIG. 3 shows the holes or openings 21 in elliptical form. FIG. 4 shows openings in oblong form. These openings range in size from about 0.2 cm to about 1 cm and more preferably about 0.3 cm to 0.5 cm. This size range prevents the buttons or snaps which are attached to the garments form getting caught and cause damage to that garment.

For optimum abrading efficiency, two parameters must be considered:

(1) the ratio process liquid weight to the fabric or garment load weight; and (2) the rotational speed of the drum.

The proper amount of process liquid required to obtain uniform abrasion is important. An insufficient amount of the liquid in the drum will cause the garments to become tangled with each other and limit only certain areas of the garment to the abrasion of the tumbling rib, thereby producing an uneven finish to the fabric and garment. While an excess of process liquid will act as a lubricant and not allow the garment to be picked up by the tumbling ribs which reduces the scraping action required to impart the degree of abrading desired to produce the stone washing effect. The proper ratio of process liquid weight to load weight of the fabrics or garment is about 4:1 about 15:1.

Another critical parameter in improving the abrading efficiency of commercial washer-extractors is the proper rotational speed of the drum. However, commercial washers are manufactured in different diameter dimensions and load capacities, a specific rotational speed range to yield the desired degree of abrasion cannot be established. For efficient abrading the proper rotational speed can be determined by observing the movement of the garments within the drum. For example, in a drum having four tumbling ribs such as shown in FIG. 1, fabrics and garments are introduced along with a sufficient amount of process liquid. The proper rotational speed permits the outer garments to an abrading action during the left portion of the clockwise rotational movement, i.e., from 6 o'clock to 11 o'clock and the inner garments receive some abrading action when they come in contact with the outer garments in the lift and fall modes. Inner garments do not contact the tumbling ribs. As the outer garments fall to the bottom of the drum they become the inner garments and fall on the tumbling rib abrading the contacting garment. The tumbling ribs hold the garments in position to the fall point and this cycle continues for the duration of the process time giving a uniform finish to all the treated garments. Preferably, the machine also can be operated to rotate in a counter-clockwise fashion to even the wear on the tumbling ribs.

Thereafter, the wash water is drained, one or more rinse cycles are conducted and the abraded fabric or garment is removed and dried.

Figure 5:
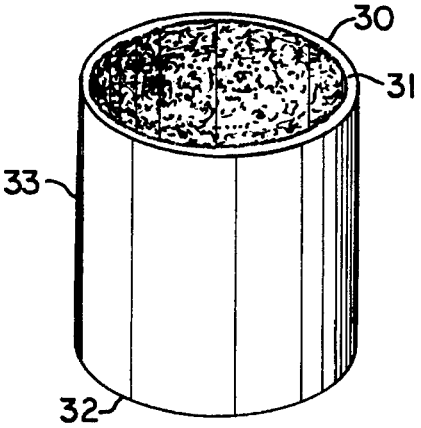
FIG. 5 is a plan view of another form of a panel with the shape of slot openings.

FIG. 5 illustrates another embodiment is directed to an abrasive structure unit adapted for use in a household washing machine. The removable abrasive unit 30 is portable and may be withdrawn to revert the machine to conventional laundering. The cylindrical unit 30 comprises an open top cylindrical collar 31 with an open cylindrical base 32 which are joined by at least two panels of the abrasive structure surface 33 to form unit 30 with the abrasive surface facing inward. The joining of the components may be accomplished by conventional attachment such as by welding.

The process liquid may be water or an aqueous solution of soap, detergents or desizing agent or mixture thereof.

EXAMPLE 1

A load of denim garments weighing 100 pounds is introduced into the tumbler compartment of a commercial washing machine (Washex) modified with the tumbling ribs according to the present invention. Water at 140°–150° F. is added together with 3 weight percent of a desizing agent and 3 weight percent of a detergent. The machine is agitated for about 10 to about 90 minutes until the desired degree of stone washing is obtained. Optionally during this phase ozone may be introduced into the tumbler to enhance the desizing and as a bleaching agent. The aqueous liquid is then drained and the garments are rinsed with cold water.

The abraded denim garments are then rinsed with a 2% by weight of a textile softener. The softener solution is drained and the garments are removed from the machine and dried. In the example a cold water rinse is sufficient, i.e., tap water temperature. In some circumstances warm water may be used as is shown in the laundry process.

The finished denim garments have a uniform soft worn appearance.

While the foregoing is illustrative of the preferred embodiments of the invention, it is clear that other modifications may be had within the scope of the invention.

What is claimed:

1. In a washer-extractor having a rotary barrel, the improvement comprising an abrasive structure mounted within said barrel for rotation with said barrel, said abrasive structure comprising:

(1) a structural form having exterior metal surface areas; and (2) a layer of corrosion resistive material forming an abrasive surface affixed to said exterior metal surface area;

wherein said material is affixed to said exterior metal surface area by using a molten metal technique forming peaks and valleys.

2. The abrasive structure in the washer-extractor of claim 1 wherein said molten metal techniques are selected from welding, oxy/fuel torch or arc spray system.

3. The abrasive structure in the washer-extractor of claim 2 wherein said molten metal technique is an arc spray system.

4. The abrasive structure in the washer-extractor of claim 1 wherein said material is compatible with said exterior metal surface area to avoid electrolysis.

5. The abrasive structure in the washer-extractor of claim 1 wherein said material forms an abrasive surface along the entire wall of said barrel.

6. The abrasive structure in the washer-extractor of claim 1 wherein said material forms an abrasive surface on tumbling ribs.

7. The abrasive structure in the washer-extractor of claim 1 wherein the affixed abrasive material ranges from fine to coarse.

8. The abrasive structure in the washer-extractor of claim 1 wherein said exterior metal surface areas and said corrosion resistive materials are made out of stainless steel.

9. The abrasive structure in the washer-extractor of claim 1 wherein the structural form is a rectilinear panel.

10. The abrasive structure in the washer-extractor of claim 9 wherein said rectilinear panel contains a plurality of openings selected from elliptical, oblong or circular shapes.

11. The abrasive structure in the washer-extractor of claim 10 wherein said plurality of openings are circular in shape.

12. A removable abrasive structure unit for use in a conventional household automatic washing machine comprising:

an open top cylindrical collar;

an open cylindrical base; and at least two panels of claim 9 to connect said collar to said base.

13. In a rotary drum washer-extractor, the improvement which comprises at least one abrasive structure for abrading fabrics or garments positioned within said rotary drum, said abrasive structure comprising:

(1) a structural form having exterior metal surface areas; and (2) a layer of corrosion resistant material forming an abrasive surface affixed to said exterior metal surface areas;

wherein said material is affixed to said exterior metal surface areas by using a molten metal technique forming peaks and valleys.

14. The washer-extractor of claim 1 wherein a plurality of said abrasive structures form tumbling ribs attached to said rotary drum.

15. The washer-extractor of claim 1 wherein said abrasive structure has a plurality of openings.

16. The washer-extractor of claim 15 wherein said openings are circular in shape.

17. The washer-extractor of claim 15 wherein the abrasive structure forms an entire interior cylinder wall of the rotary drum with an outer cylinder capable of holding processing liquid.

18. The washer-extractor of claim 1 which contains means for introducing ozone into said washer-extractor.

19. A method of abrading fabrics or garments in a rotary drum washer-extractor having at least one abrasive structure of claim 1 comprising the steps of:

(a) introducing a process liquid and fabric or garments into said drum;

(b) rotating said drum to contact said abrasive structure until said fabric or garment is uniformly abraded.

20. The method of claim 19 wherein said process liquid is selected from water, detergent, soap, desizing agent or mixtures thereof.

21. The method of claim 19 including the step of introducing ozone into said washer-exterior.

* * * * *